US006110031A

United States Patent [19]

Preston et al.

[11] Patent Number: 6,110,031

[45] **Date of Patent: *Aug. 29, 2000**

[54] SUPERABRASIVE CUTTING SURFACE

[75] Inventors: Jay B. Preston, Woodbury, Minn.; Naum N. Tselesin, Atlanta, Ga.

[73] Assignee: 3M Innovative Properties Company, St. Paul, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/882,434

[22] Filed: Jun. 25, 1997

[51] Int. Cl.[7] ..... B23F 21/03

[52] U.S. Cl. ..... 451/541; 451/547; 451/527; 451/529

[58] Field of Search ..... 451/541, 547, 451/527, 529

[56] References Cited

U.S. PATENT DOCUMENTS

| | | | |
|---|---|---|---|
| 4,131,436 | 12/1978 | Wiand . | |
| 4,341,532 | 7/1982 | Oide . | |
| 4,925,457 | 5/1990 | deKok et al. . | |
| 5,049,165 | 9/1991 | Tselesin . | |
| 5,092,910 | 3/1992 | deKok et al. . | |
| 5,190,568 | 3/1993 | Tselesin . | |
| 5,197,249 | 3/1993 | Wiand . | |
| 5,203,880 | 4/1993 | Tselesin . | |
| 5,380,390 | 1/1995 | Tselesin . | |
| 5,385,591 | 1/1995 | Ramanath et al. . | |
| 5,489,235 | 2/1996 | Gagliardi et al. . | |
| 5,518,443 | 5/1996 | Fisher | 451/540 |
| 5,620,489 | 4/1997 | Tselesin . | |
| 5,656,045 | 8/1997 | Wiand . | |
| B1 4,925,457 | 9/1995 | deKok et al. . | |
| B1 5,049,165 | 9/1995 | Tselesin . | |
| B1 5,092,910 | 9/1995 | deKok et al. . | |
| B1 5,190,568 | 3/1996 | Tselesin . | |
| B1 5,203,880 | 10/1995 | Tselesin . | |
| B1 5,380,390 | 10/1996 | Tselesin . | |

FOREIGN PATENT DOCUMENTS

| | | |
|---|---|---|
| 63-207565 | 8/1988 | Japan . |
| 3-161278 | 7/1991 | Japan . |
| 3-190673 | 8/1991 | Japan . |
| 06312376 | 11/1994 | Japan . |
| 9-19869 | 1/1997 | Japan . |
| WO 96/20069 | 7/1996 | WIPO . |

OTHER PUBLICATIONS

3M Roll Grinding, Superfinishing and Microfinishing Systems—Marketing literature.

3M Roloc Flexible Diamond Discs—Marketing literature.

3M Flexible Diamond Products for Industrial Markets, Feb. 10, 1997, PL–159—Marketing literature.

*Primary Examiner*—David A. Scherbel
*Assistant Examiner*—Shantese McDonald
*Attorney, Agent, or Firm*—Scott R. Pribnow

[57] ABSTRACT

An abrasive surface for cutting and grinding tools and having abrasive particles embedded in a filler material. The abrasive surface is bonded to the perimeter edge of a rigid hub and has a circumferential dimension and a width dimension. The abrasive surface is divided along both the circumferential dimension and the width dimension into a plurality of hard regions and soft regions. The hard regions wear more slowly that the soft regions and so different patterns of hard regions and soft regions produce different cutting profiles. A method for fabricating the abrasive surface includes forming a laminated sheet from a plurality of laminated layers. Each laminated layer includes at least a layer of soft, easily deformable material and a layer of abrasive particles. The layers of abrasive particles can be formed into staggered rows to form the pattern of hard regions and soft regions. The layers of the laminated layers are sintered together to form the laminated sheet from which the abrasive surface is cut.

21 Claims, 8 Drawing Sheets

SUPERABRASIVE CUTTING SURFACE

BACKGROUND OF THE INVENTION

1. Field of the Invention

The present invention relates generally to cutting and grinding tools. In particular the present invention includes a superabrasive surface for use with circular cutting and grinding tools and a method for making the same.

2. Description of the Related Art

Materials such as granite, marble, filled concrete, asphalt and the like are typically cut using superabrasive saw blades. These blades include a circular steel disc having a work surface made up of a plurality of spaced segments about the perimeter of the disk, the segments having superabrasive surfaces for the cutting of the material. Further, plastic and glass lenses for optical devices such as eyeglasses are commonly shaped using grinding wheels which have a superabrasive work surface. The abrasive portions of these saw blades or grinding wheels usually include particles of super hard or abrasive material, such as diamond, cubic boron nitride, or boron suboxide surrounded by a filler material and/or embedded in a metal matrix. It is these abrasive particles that act to cut or grind a work piece as it is placed against a rotating work surface of the cutting or grinding tool.

The arrangement of the particles of abrasive material in the work surface is important to performance of the cutting or grinding tool. First, an unvarying or homogeneous concentration or hardness of abrasive material in a direction along the circumference of the cutting surface results in reduced cutting performance. As such it is advantageous to be able to vary the concentration or hardness of abrasive particles in the cutting surface to produce a surface of varying abrasiveness. For example, Fisher, in U.S. Pat. No. 5,518,443 for a Superabrasive Tool issued May 21, 1996, discloses a tool having a cutting surface divided in the circumferential direction into segments having varying concentrations of abrasive particles. Regions of lower concentration of abrasive material will wear faster than regions of higher concentrations of abrasive particles exposing fresh high concentration regions. These fresh regions cut more effectively than worn regions of higher concentration of cutting material thereby increasing the cutting performance of the tool.

Second, it is known in the art to form cutting surfaces in which the concentration of abrasive particles in the cutting surface varies in a direction of the axis of rotation of the abrasive tool. For example, Wiand, in U.S. Pat. No. 4,131,436 for Ophthalmic Flat Roughing Wheel, issued Dec. 26, 1978, discloses a grinding wheel in which the concentration of abrasive particles in the surface of the grinding wheel comprises layers which define a zone of high abrasive particle concentration in the axial center of the wheel with zones of lower abrasive particle concentration on either side. However, as noted above, a region of lower concentration of abrasive particles will wear down faster than a region of relatively higher concentration of abrasive particles. Thus, after a period of use, a cutting or grinding tool of the type disclosed in Wiand develops a characteristic edge pattern across the width of the cutting surface in the direction of the axis of rotation of the tool. This characteristic edge is known as the tool's wear profile.

The wear profile of a superabrasive cutting or grinding tool affects the quality of the cut performed on a work object. For example, it is likely that the type of tool disclosed in Wiand would develop a rounded, convex wear profile that has radially low spots at the outer edges of the tool in the direction of the axis of rotation of the tool and radially high spots in the center of the tool between the low spots. This type of wear profile is generally undesirable because it can produce a somewhat ragged-edge cut and the circular steel disk can be unexpectedly exposed at the radially low edges of the tool during a cut, causing unintended cutting results.

It is more desirable to have a concave wear profile wherein high spots are created at the edges of the profile and a low spot is created in the center of the profile. This type of wear profile can produce a clean-edged cut and tends not to expose the circular steel disk prematurely and allows more efficient use of abrasive material. Also, it may also be desirable to have slightly different, and more complex, cutting profiles dependent upon the work object and the type of cut desired.

Third, the life of the tool and the speed of the cut are also dependent upon the arrangement of the particles in the work surface and the composition of the work surface. A work surface in which abrasive particle are embedded in a relatively soft bond material can cut faster because the worn particles are pulled from the soft bond material relatively rapidly, exposing fresh abrasive particles. This type of work surface, however can wear relatively quickly. On the other hand, abrasive particles embedded in a relatively hard bond material can cut relatively more slowly because worn particles are not pulled from the hard bond material so quickly to expose fresh abrasive particles. This type of work surface, however, can have relatively long life.

Finally, abrasive material used in such cutting or grinding tools is relatively expensive; thus, it is desirable to reduce the quantity of abrasive material necessary without reducing the performance of the cutting or grinding tool.

As such, it is advantageous to be able to control the wear profile of a superabrasive cutting or grinding tool. Further, it is advantageous to have a work surface which will provide relatively rapid cutting with a relatively long life. Also, such a tool should be efficient and relatively inexpensive to manufacture.

SUMMARY OF THE INVENTION

The present invention includes a circular tool for cutting and grinding and having a work surface mounted to a rigid circular hub such that the work surface has a circumferential dimension orthogonal to an axial dimension. The work surface also has abrasive particles embedded therein and is divided along the circumferential dimension and the axial dimension into a plurality of first regions having a first regions and a plurality of second regions. Each first region is more wear resistant than each second regions. As such, second regions will wear faster than first regions. In this way different patterns of first and second regions in the circumferential dimension and axial dimension will produce different wear profiles and a desirable compromise between cutting speed and tool life can be obtained.

A method of fabricating the work surface includes forming a laminated sheet having a plurality of laminated layers. Each laminated layer includes at least a layer of bond or filler material, and a layer of abrasive particles. The concentration and/or type of abrasive particles in at least one of the layers of abrasive particles is varied across a width and/or length of the layer to form the first and second regions of the work surface. The laminated layers are sintered to form the laminated sheet from which the work surface is cut.

DETAILED DESCRIPTION OF THE PREFERRED EMBODIMENTS

Figure 1:
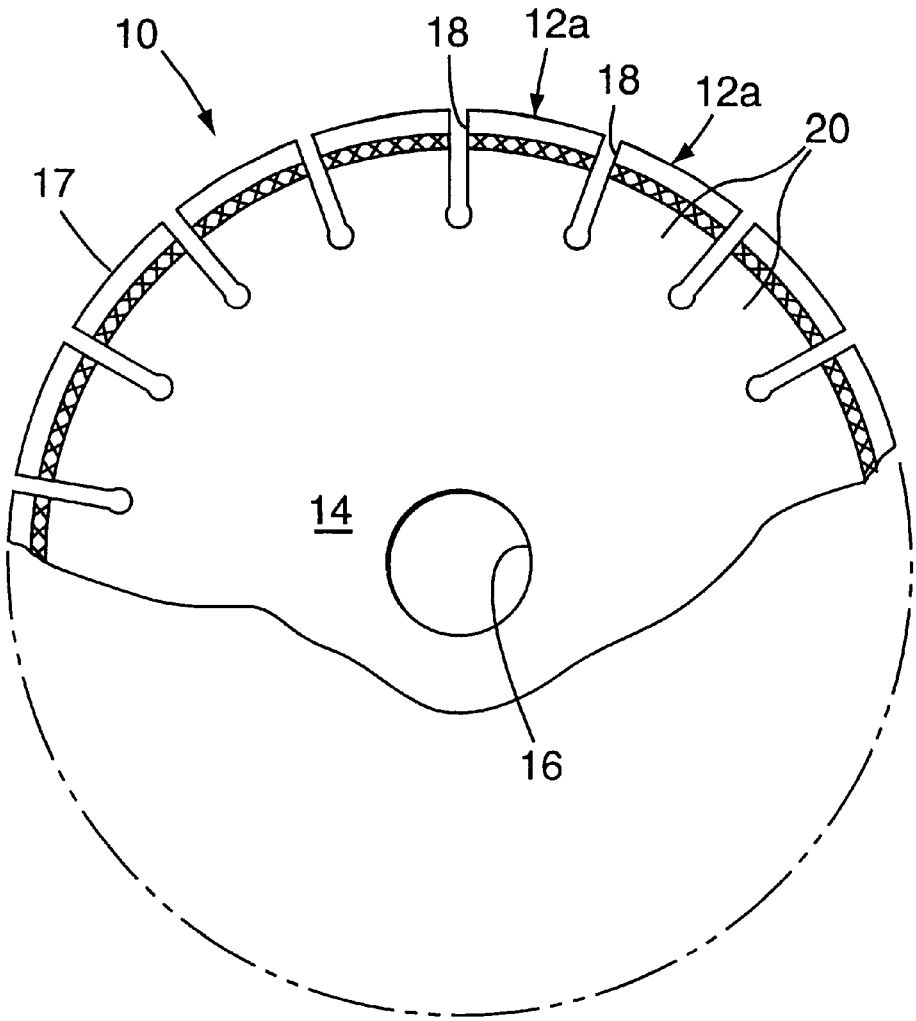
FIG. 1 is a front view of a cutting tool including abrasive segments in accordance with the present invention mounted about a perimeter of the cutting tool.

FIG. 1 shows an abrasive wheel or saw blade 10 for cutting hard materials such as granite, marble and concrete and including abrasive segments 12*a* forming an abrasive work surface 17 in accordance with the present invention. Wheel 10 includes a circular center hub 14 formed from steel or other rigid material. A hole 16 is formed in the center of hub 14 for conventionally mounting wheel 10 onto a drive means (not shown) to rotatably drive wheel 10. Circumferentially spaced slots 18 preferably extend from the outer perimeter of wheel 10 inward towards the center thereof in a radial direction to form support members 20 in hub 14 between adjacent slots 18. Each abrasive segment 12*a* is mounted at the outer edge of a support member 20 by laser beam fusion welding, electron beam fusion welding, soldering, brazing, or other methods known in the art. Suppliers of soldering and brazing equipment and supplies include: Engelhard Corp., Metal Joining Group of Warwick R.I.; Cronatron Welding Systems, Inc. of Charlotte, N.C.; and Atlantic Equipment Engineers of Berginfield, N.J.

Figure 2:
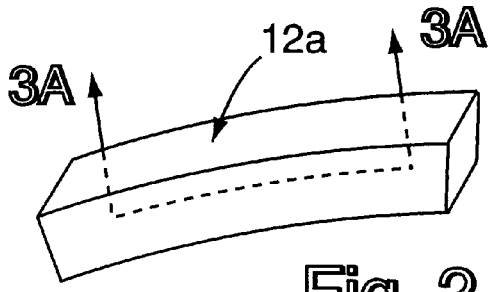
FIG. 2 is a isometric view of an abrasive segment of the type shown in FIG. 1.

FIG. 2 is an isometric view of an individual segment 12*a* shown in FIG. 1. In the embodiment of FIG. 2, segment 12*a* is in the shape of an arcuate section of a circular band having a curvature substantially equal to that of circular hub 14 to which segment 12*a* is to be mounted. Segment 12*a* is elongated in the direction of the circumference of the circular band and has a width in the direction of the axis of rotation of wheel 10, which is orthogonal to the circumferential direction. As such, work surface 17 has an axial dimension orthogonal to a circumferential dimension. Preferably, segment 12*a* has an arc of about 7 to 20 degrees.

Segment 12*a* contains particles of abrasive or hard material such as diamond, cubic boron nitride, boron carbide, boron suboxide, and/or silicon carbide suspended in a matrix of bond or filler material which can also be abrasive. As such, by mounting wheel 10 to a rotatably driven rod through hole 16, an edge of segment 12*a* acts to cut a work object placed against the perimeter edge of rotating wheel 10.

The type and arrangement of the superabrasive particles and the type of bond material of segment 12*a* is important to the wear profile created on work surface 17 and, therefore, the cutting performance thereof. Segment 12*a* is divided into hard regions and soft regions. Soft regions can contain a lower concentration of abrasive material than hard regions or a less abrasive type of material than hard regions, or a combination of both a lower concentration of abrasive material and a less abrasive type of material. Accordingly, hard regions have a higher concentration of abrasive material and/or a more abrasive type of material than soft regions, or a combination of both. Hard and soft regions are so named because a more abrasive particle of similar size and shape is typically a harder particle. It is also contemplated to use different compositions of bond material in the work surface 17. Bond materials can also be harder and softer. By varying the concentration and type of abrasive particles and the compositions of the bond material in work surface 17, soft regions can wear more rapidly than hard regions.

Soft regions and hard regions are circumferentially spaced in segment 12*a*, that is, spaced in the circumferential dimension of wheel 10, and axially spaced in segment 12*a*, that is spaced in the direction of the axis of rotation of wheel 10. In this way, the wear profile of work surface 17 can be determined by the position of hard regions and soft regions in segment 12*a*.

Also, by varying the concentration and/or type of abrasive material, and/or by varying the composition of the bond material, at the cutting surface of segment 12*a*, the cutting efficiency of wheel 10 can be improved. That is, the life of the work surface 17 can be improved while retaining relatively high cutting speed. Finally, by having regions of reduced concentration of expensive abrasive particles, such as diamonds, wheel 10 can be relatively less expensive to produce that a cutting or grinding tool having a cutting surface with a continuously high concentration of expensive abrasive particles.

Figure 3A:
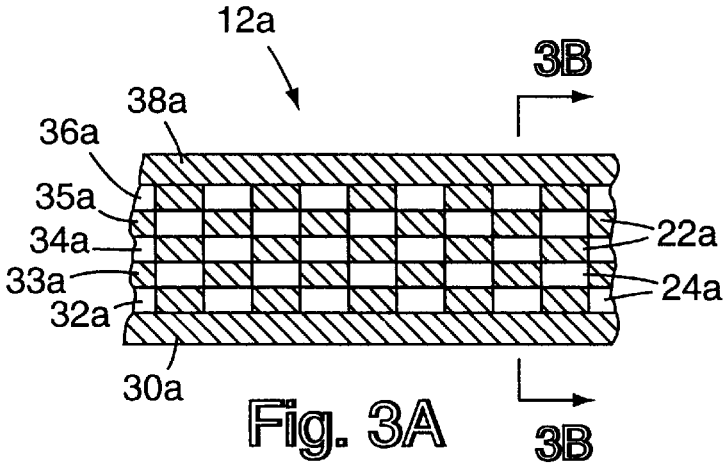
FIG. 3A is a sectional view of the abrasive segment shown in FIG. 2 taken along line 3A—3A of FIG. 2.

FIG. 3A, which is a sectional view of segment 12*a* along line 3A—3A of FIG. 2, shows one embodiment of the present invention including a first arrangement of superabrasive material in segment 12*a*. Shaded areas in FIG. 3A show hard regions 22*a* and unshaded areas show soft regions 24*a*. As shown in FIG. 3*a*, segment 12*a* can be divided into 7 axial thickness layers 30*a*, 32*a*, 33*a*, 34*a*, 35*a*, 36*a*, and 38*a*. Although in the embodiment of FIG. 3A, thickness layers 30*a*, 32*a*, 33*a*, 34*a*, 35*a*, 36*a*, and 38*a* are of substantially equal width in the axial direction, that is width along a direction of the axis of rotation of wheel 10, it is within the ambit of the present invention for thickness layers to be of different axial width. Exterior thickness layers 30*a* and 38*a* completely comprise hard regions 22*a*. In each interior thickness layer 32*a*, 33*a*, 34*a*, 35*a*, and 36*a*, hard regions 22*a* are circumferentially spaced, that is, spaced in the direction of the circumference of wheel 10, between soft regions 24*a*. Soft regions 24*a* are of approximately equal circumferential length, that is of approximately equal length in a direction along the circumference of wheel 10, as hard regions 22*a*. Further, the hard regions 24*a* of alternate interior thickness layers 32*a*, 34*a*, and 36*a* are circumferentially offset, that is, offset in a direction along the circumference of wheel 10, from the hard regions 24*a* of alternate interior thickness layers 33*a* and 35*a* Accordingly, the arrangement of abrasive particles in segment 12*a* forms a checker board pattern of zones having different abrasiveness which alternate in both the axial and circumferential direction and are sandwiched between exterior thickness layers 30*a* and 38*a*, each being entirely hard region 22*a*.

Figure 3B:
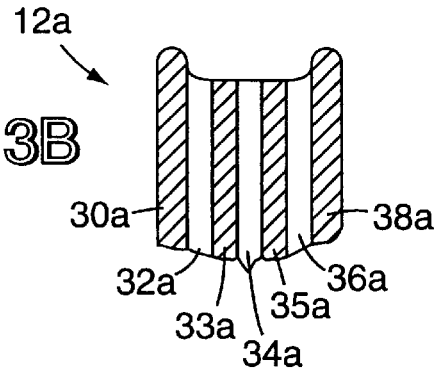
FIG. 3B is a sectional view of the abrasive segment shown in FIG. 2, after the segment has been used sufficiently to define a wear profile at is edge, taken along line 3B—3B of FIG. 3A.

As wheel 10 is used, soft regions 24*a* will wear more rapidly than hard regions 22*a* As such, the interior thickness layers 32*a* through 36*a* will wear more rapidly than exterior thickness layers 30*a* and 38*a*. FIG. 3B is a sectional view of segment 12 taken along line 3B—3B of FIG. 3A and shows an estimation of the wear profile that is expected to be produced in segment 12*a*. The wear profile has a radially lower area, that is an area having a smaller radius on wheel 10, axially across interior thickness layers 32*a* through 36*a* of segment 12*a* and radially higher areas, that is areas having larger radii on wheel 10, axially across exterior thickness layers 30 and 38. This type of wear profile produces a precise cut. Further use of a tool having this type of wear profile can reduce the possibility of the cutting surface prematurely wearing to hub 14.

FIGS. 4A, 5A, 6A, 7, and 8 show alternate embodiments of the arrangement of hard regions and soft regions in abrasive segments of the type shown in FIG. 2 in the same view as shown in FIG. 3A. Elements in FIGS. 4A–8 that are functionally similar to elements in FIGS. 1, 2, 3A, and 3B are labeled with like numerals designated by different letters. These alternate arrangements wear at different overall speeds and produce different wear profiles and, hence, abrade the work object in different ways. The specific use of the cutting tool determines the desirability of the different wear patterns produced.

Figure 4A:
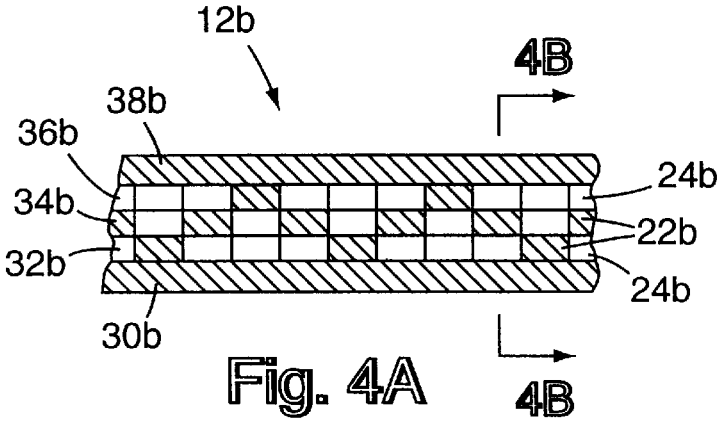
FIG. 4A is a sectional view of a second embodiment of an abrasive segment of the type shown in FIG. 2 taken along a section line equivalent to line 3A—3A of FIG. 2.

FIG. 4A shows a segment 12*b* having 5 axial thickness layers 30*b*, 32*b*, 34*b*, 36*b* and 38*b* of preferably substantially equal axial width. Exterior thickness layers 30*b* and 38*b* are similar to exterior thickness layers 30*a* and 38*a*, respectively, shown in FIG. 3A. The side interior thickness layers 32*b* and 36*b* each has hard regions 22*b* circumferentially spaced with soft regions 24*b* of approximately three times the circumferential length of hard regions 22*b* thereof. Center interior thickness layer 34*b* has hard regions 22*b* circumferentially spaced with soft regions 24*b* of approximately equal circumferential length as hard regions 22*b* thereof Also, the placement of hard regions 22*b* are circumferentially offset from thickness layer 32*b* to thickness layer 34*b* to thickness layer 36*b* by approximately the circumferential length of a hard region 22*b*. As such, the spacing arrangement in both the circumferential direction and the axial direction in segment 12*b* forms a zigzag pattern of zones having different abrasiveness and sandwiched between exterior thickness layers 30*b* and 38*b*. This arrangement results in approximately three times the area of soft region 24*b* in each side interior thickness layer 32*b* and 36*b* than in center interior thickness layer 34*b*. Therefore, side interior thickness layers 32*b* and 36*b* will wear more rapidly than center interior thickness layer 34*b*. And, as with segment 12*a*, the exterior thickness layers 30*b* and 38*b*, which have no soft regions 24*b*, will wear slower than any of the interior thickness layers 32*b*, 34*b*, and 36*b*.

Figure 4B:
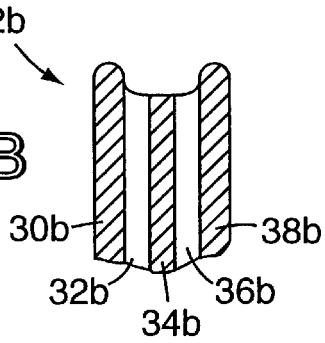
FIG 4B is a sectional view the abrasive segment shown in FIG. 4A, after the segment has been used sufficiently to define a wear profile at is edge, taken along line 4B—4B.

FIG. 4B is a sectional view of segment 12*b* taken along line 4B—4B of FIG. 4A and shows an estimation of the wear profile that is expected to be produced in segment 12*b*. The wear profile has a radially lower area axially across side interior thickness layers 32*b* and 36*b*, a radially intermediate height area across center interior layer 34*b* and radially high areas on either exterior edge along thickness layers 30*b* and 38*b*.

Figure 5A:
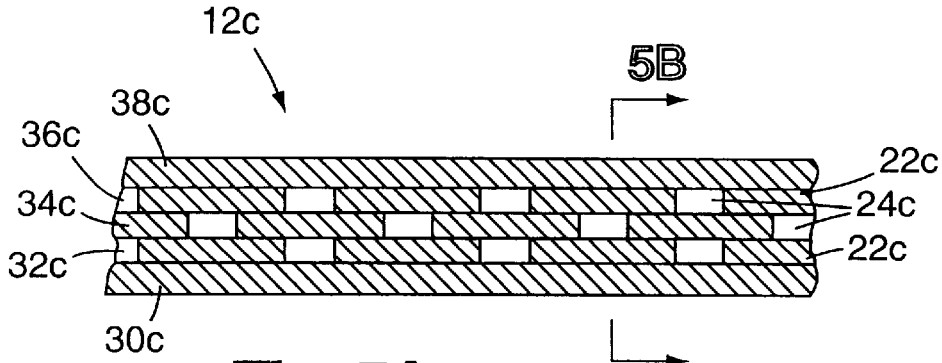
FIG. 5A is a sectional view of a third embodiment of an abrasive segment of the type shown in FIG. 2 taken along a section line equivalent to 3A—3A of FIG. 2.

FIG. 5A shows a segment 12*c* having 5 thickness layers 30*c*, 32*c*, 34*c*, 36*c*, and 38*c* of substantially equal axial width. Exterior thickness layers 30*c* and 38*c* are similar to external thickness layers 30*a* and 38*a*, respectively, shown in FIG. 3. Each interior thickness layer 32*c*, 34*c*, and 36*c* has hard regions 22*c* circumferentially spaced between soft regions 24*c* of approximately one quarter the circumferential length of adjacent hard regions 22*a* thereof. Also, the hard regions 22*c* of side interior thickness layers 32*c* and 36*c* are aligned with each other in an axial direction and the hard regions 22*c* of center interior thickness layer 34*c* are circumferentially offset therefrom. As such, the hard regions 22*c* of center interior thickness layer 34*c* circumferentially overlap with the hard regions 22*c* of side interior thickness layers 32*c* and 36*c*. As with segments 12*a* and 12*b*, this construction advantageously results in a segment having abrasive zones that vary both in the circumferential direction as well as in the direction of the axis of rotation of wheel 10.

Figure 5B:
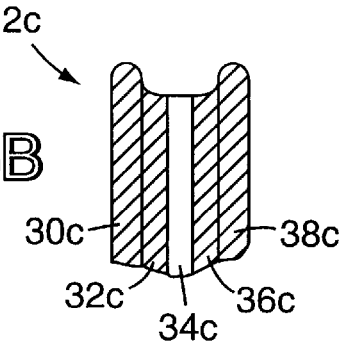
FIG. 5B is a sectional view of the abrasive segment shown in FIG. 5A, after the segment has been used sufficiently to define a wear profile at is edge, taken along line 5B—5B.

Because there is a relatively smaller amount of soft region 24*c* in interior layers 32*c*, 34*c* and 36*c*, these layers will wear relatively more slowly that the interior thickness layers 32*a*, 34*a*, and 36*a* of segment 12*a*. However, because there substantially equal ratios of soft region 24*c* to hard region 22*c* in each interior layer 32*c*, 34*c*, and 36*c*, each layer will wear at approximately the same rate. Thus, the expected wear profile is shown in FIG. 5B, which is a sectional view of segment 12*c* taken along line 5B—15B of FIG. 5A.

Figure 6A:
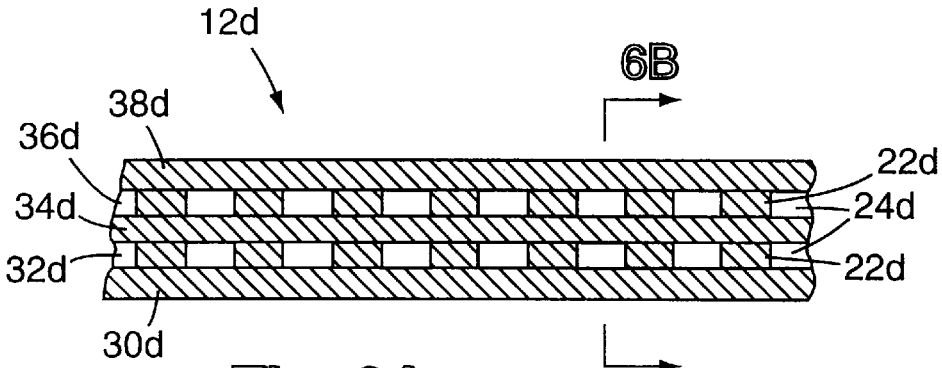
FIG. 6A is a sectional view of a fourth embodiment of an abrasive segment of the type shown in FIG. 2 taken along the a section line equivalent to line 3A—3A of FIG. 2.
Figure 6B:
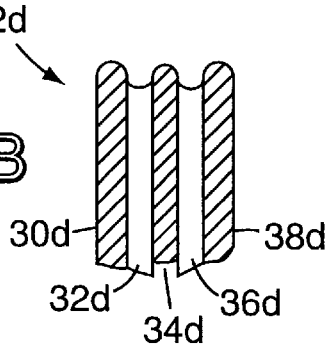
FIG. 6B is a sectional view of the abrasive segment shown in FIG. 6A, after the segment has been used sufficiently to define a wear profile at is edge, taken along line 6B—6B.

FIG. 6A shows a segment 12*d* having 5 thickness layers 30*d*, 32*d*, 34*d*, 36*d*, and 38*d* with preferably substantially equal axial width. External thickness layers 30*d* and 38*d* are similar to external thickness layers 30*a* and 38*a*, respectively, shown in FIG. 3A. Side interior thickness layers 32*d* and 36*d* have hard regions 22*d* circumferentially spaced between soft regions 24*d* of approximately equal circumferential length as hard regions 22*d* thereof. Center interior thickness layer 34*d* has no area of soft region 24*d* and, thus, is continuous hard region 22*d*. As such, center interior thickness layer 34*d* will wear at approximately the same rate as exterior thickness layers 30*d* and 38*d*. Because side interior thickness layers 32*d* and 36*d* have areas of soft region 24*d*, these layers will wear faster. As such, the expected wear profile is shown in FIG. 6B, which is a sectional view of section 12*d* taken along line 6B—6B of FIG. 6A.

Figure 7:
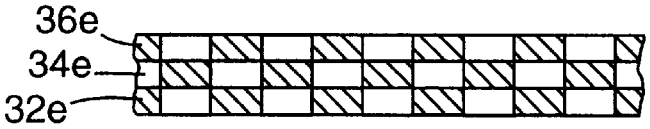
FIG. 7 is a sectional view of a fifth embodiment of an abrasive segment of the type shown in FIG. 2 taken along a section line equivalent to line 3A—3A of FIG. 2.

FIG. 7 shows a segment 12*e* consisting of only three layers 32*e*, 34*e* and 36*e*, which are similar to interior layers 32*a*, 33*a*, and 34*a* of segment 12*a*. The exterior thickness layers 30*a* and 38*a* of segment 12*a*, however, are not included in segment 12*e*. Thus, the wear profile will be relatively uniform axially across layers 32*e*, 34*e*, and 36*e*.

Figure 8:
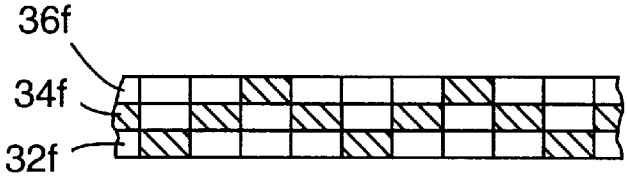
FIG. 8 is a sectional view of a sixth embodiment of an abrasive segment of the type shown in FIG. 2 taken along a section line equivalent to line 3A—3A of FIG. 2.

FIG. 8 shows segment 12*f* consisting of three layers 32*f*, 34*f*, and 36*f*, which are similar to layers 32*b*, 34*b*, and 36*b* of segment 12*b*. The exterior thickness layers 30*b* and 38*b* of segment 12*b*, however, are not included in segment 12*f*. Thus, the wear profile would appear substantially as the wear profile of segment 12*b*, shown in FIG. 4B, axially across interior thickness layers 32*b*, 34*b* and 36*b*.

It is also within the ambit of the present invention to form a segment of a type similar to segment 12*a* but having only three layers with the arrangement of hard regions and soft regions the same as that of layers 32*c*, 34*c* and 36*c* of segment 12*c* shown in FIG. 5A or the same as that of layers 32*d*, 34*d*, and 36*d* of segment 12*d* shown in FIG. 6A.

The above described embodiments divide the work surface of a cutting tool into regions having relatively high abrasiveness and relatively low abrasiveness. However, it is also contemplated to form a work surface of a cutting tool divided into regions of more than two different levels of abrasiveness. That is, the work surface could be divided circumferentially and axially into regions of three or more different levels of abrasiveness. Each type of region can include relatively high, intermediate, and low concentrations of abrasive material, respectively, and/or relatively highly abrasive, moderately abrasive, and less abrasive materials, respectively.

Further, though the embodiments of the present invention specifically described above have either 3, 5 or 7 layers, it is also contemplated to form a segment of a type similar to segment 12*a* having 1, 2, 4, 6, 8, or any number of layers that is desirable to provide a cutting function and wear profile depending on the desired application. Moreover, thicknesses of the layers need not be the same. Also, the layers can have any circumferentially and axially alternating configuration of regions of different levels of abrasiveness.

It is also contemplated to use a harder or softer bond material in one or more thickness layers. Using a harder bond material can cause a layer to wear slower and using a softer bond material can cause a layer to wear more rapidly. As such, the wear profile and cutting life of cutting surface 17 can be advantageously varied.

Figure 9:
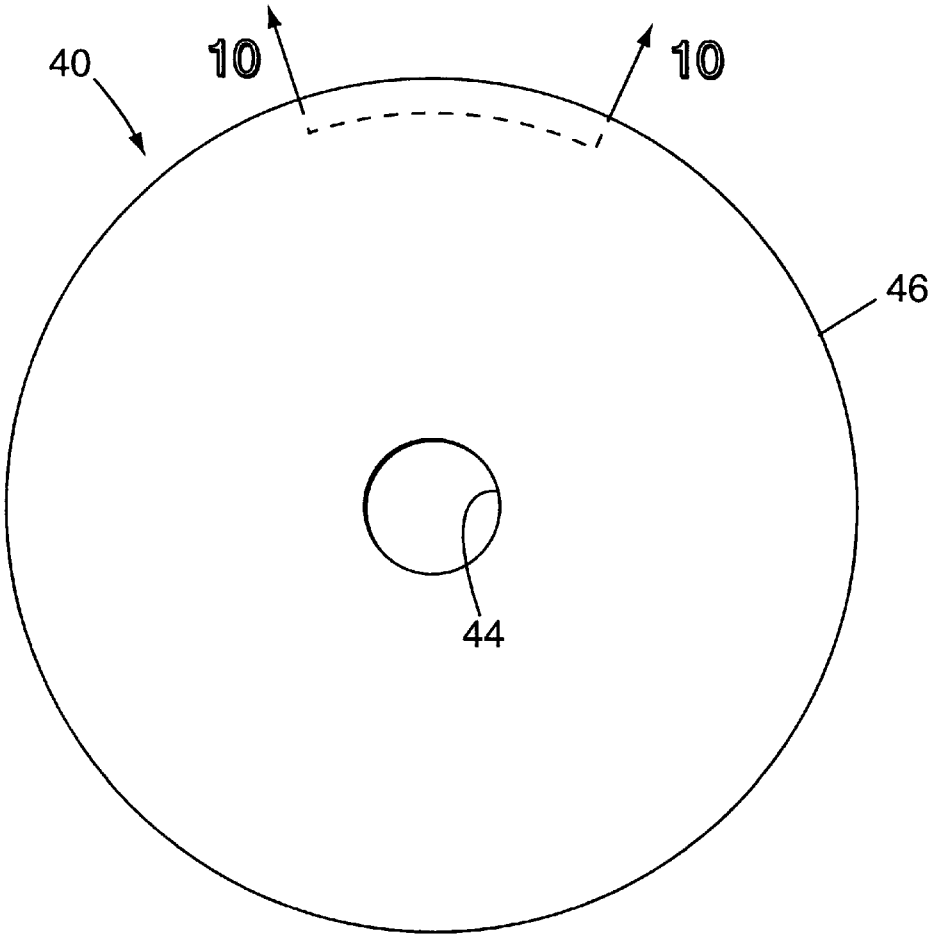
FIG. 9 is a front view of a grinding tool having an abrasive surface in accordance with the present invention.

It is also within the ambit of the present invention to form a continuous closed circular band of abrasive cutting material rather than only the segments 12*a*–12*f* of cutting material described above. Such a continuous band can be used as a grinding wheel 40, a side view of which is shown in FIG. 9. Grinding wheel 40 is formed from a disk of abrasive material in accordance with the present invention. The center of the disk has been removed to form hole 44 for mounting the wheel 40 onto a rotatably driven shaft (not shown). The outer circumferential surface of wheel 40 comprises circular work surface 46 of abrasive material which has a circumferential dimension and an axial dimension. It is also within the ambit of the present invention to form a grinding wheel having a circular band of abrasive material in accordance with the present invention mounted by brazing or other known method to the perimeter of a rigid circular hub or blank.

Figure 10A:
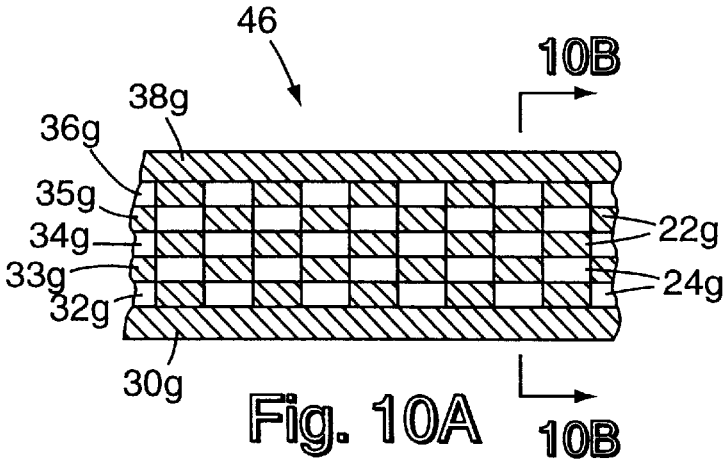
FIG. 10 is a sectional view of the abrasive surface shown in FIG. 9, after the surface has been used sufficiently to define a wear profile at is edge, taken along line 10—10.

FIG. 10A is a sectional view of surface 46 taken along line 10A—10A. Like segment 12*a*, circular work surface 46 is divided along its circumferential dimension and its axial dimension into hard regions 22*g* and soft regions 24*g*. Shaded areas in FIG. 10A show hard regions 22*g* and unshaded areas show soft regions 24*g*. Abrasive surface 46 can be divided into 7 thickness layers 30*g*, 32*g*, 33*g*, 34*g*, 35*g*, 36*g*, and 38*g* of substantially equal axial width, that is, width in the direction of the axis of rotation of wheel 40. Exterior thickness layers 30*g* and 38*g* are completely hard regions. In each interior thickness layer 32*g*, 33*g*, 34*g*, 35*g*, and 36*g*, hard regions 22*g* are circumferentially spaced, that is spaced in the direction of the circumference of wheel 40, between soft regions 24*g*. Soft regions 24*g* are of approximately equal circumferential length, that is of approximately equal length in a direction along the circumference of wheel 40, as hard regions 22*g*. Further, the hard regions 24*g* of alternate interior thickness layers 32*g*, 34*g*, and 36*g* are circumferentially offset, that is offset in a direction along the circumference of wheel 40, from the hard regions 24*g* of alternate interior thickness layers 33*g* and 35*g*. Accordingly, the arrangement of abrasive particles in surface 46 forms a checker board pattern of hard regions 22*g* and soft regions 24*g* alternating in a circumferential direction and an axial direction and sandwiched between exterior thickness layers 30*g* and 38*g* which are each entirely hard region 22*g*.

Figure 10B:
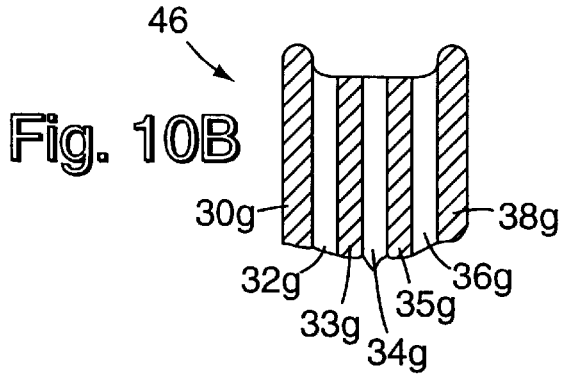

Because the surface 46 has the same pattern of hard regions 22*g* and soft regions 24*g* as segment 12*a*, the wear profile which is expected to be produced for surface 46 will be substantially the same as that for segment 12*a*. As shown in FIG. 10B, which is a sectional view of surface 46 taken along line 10B—10B of FIG 10A, the approximate wear profile of surface 46 has radially high areas across exterior thickness layers 30*g* and 38*g* and radially lower areas across interior thickness layers 32*g* through 36*g*.

It is also within the ambit of the present invention to form a grinding wheel of the type shown in FIG. 9 having a work surface with axially and circumferentially alternating patterns of soft regions and hard regions the same as those shown in FIGS. 4A, 5A, 6A, 7, and 8, or any other pattern of circumferentially and axially alternating arrangements of soft regions and hard regions.

A method of fabricating abrasive segments such as segment 12*a* or abrasive wheels such as wheel 40 includes alternating layers of bond or filler material with layers of abrasive particles and sintering the layers together. To form the alternating patterns of soft regions and hard regions, certain layers of abrasive particles are arranged in alternating groups of different types of abrasive particles or different concentrations of abrasive particles, or both.

Methods of sintering material to form abrasive articles is well known in the art and disclosed in Tselesin, U.S. Pat. No. 5,620,489 for a Method for Making Powder Preform and Abrasive Articles Made Therefrom, issued Apr. 15, 1997; Tselesin, U.S. Pat. No 5,203,880 for Method and Apparatus for Making Abrasive Tools, issued Apr. 20, 1993 and Reexamination Certificate Serial No. B1, 5,203,880 issued therefor on Oct. 17, 1995; deKok et al., U.S. Pat. No. 5,092,910 for Abrasive Tool issued Mar. 3, 1992 and Reexamination Certificate Serial No. B1 5,092,910 issued therefor on Sep. 26, 1995; Tselesin, U.S. Pat. No. 5,049,165 for Composite Material issued Sep.17, 1991 and Reexamination Certificate Serial No. B1 5,049,165 issued therefor on Sep. 26, 1995;

deKok et al., U.S. Pat. No. 4,925,457 issued May 15, 1990 and Reexamination Certificate Serial No. B1 4,925,457 issued therefor on Sep. 26, 1995; and Tselesin, U.S. Pat. No. 5,190,568 issued Mar. 2, 1993 and Reexamination Certificate Serial No. B1 5,190,568 issued therefor on Mar. 12, 1996. Each of these references is hereby incorporated by reference in its entirety.

Figure 11:
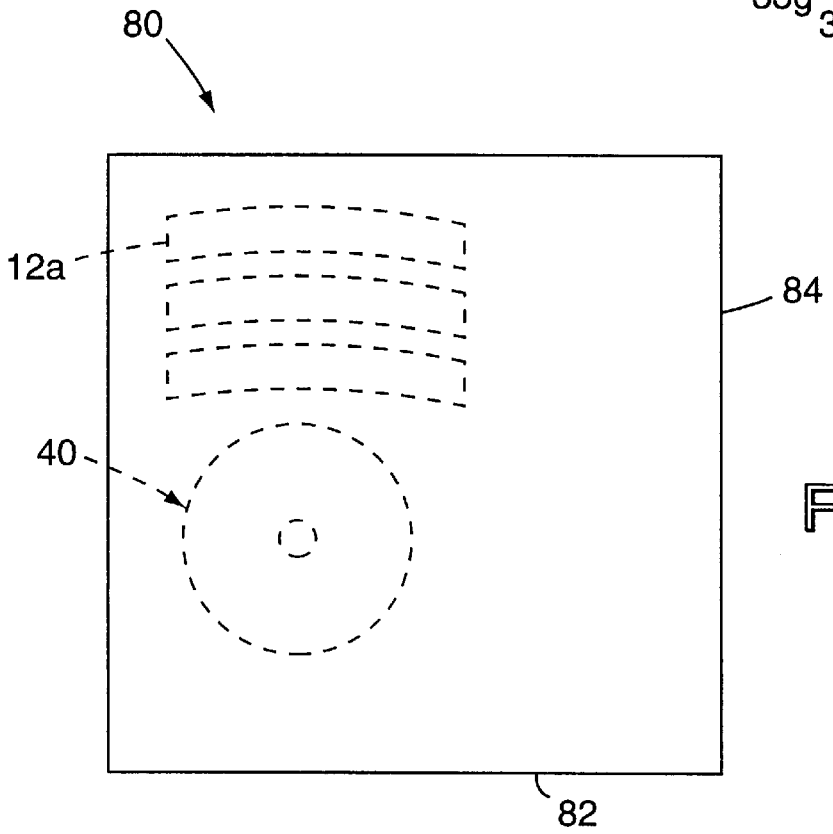
FIG. 11 is a top view of a laminated sheet of material that can be used to fabricate the abrasive segment shown in FIG. 2 or the abrasive surface shown in FIG. 9.

To form an abrasive segment of the type shown in FIG. 2 or an abrasive wheel of the type shown in FIG. 9, a laminated sheet 80, shown in a top view in FIG. 11, is formed. Laminated sheet 80 has a front edge 82 and a side edge 84. For each thickness layer desired, sheet 80 preferably is made up of a layer of bond material and a layer of abrasive particles. Sheet 80 can also include a sheet of porous material and/or a sheet of adhesive substrate for each thickness layer desired. To form the patterns of soft regions and hard regions which enable the present invention to produce a desired wear profile and, hence, a desired type of cut, the abrasive particles can be arranged in alternating groups having either different types of abrasive particles, different concentrations of abrasive particles or both. The groups can be arranged in openings of layers of porous material or can be arranged on layers of adhesive substrate, or both. If layers of porous material are used, the porous layer can be removed before sintering but need not be. The groups can also be arranged adjacent to the bond material without any layers of porous material or adhesive substrate. The layers are sintered together to form sheet 80 in which the individual layers of bond material, abrasive particles, porous material and adhesive substrate are no longer discernible.

FIG. 12 is a front view of front edge 82 of sheet 80 showing the stack up of layers which can be used in the making of segment 12*a* Segment 12*a* is made up of seven thickness layers 30*a*, 32*a*, 33*a*, 34*a*, 35*a*, 36*a*, and 38*a* Each thickness layer 30*a*, 32*a*, 33*a*, 34*a*, 35*a*, 36*a*, and 38*a* includes a bond material layer 50*a*, 52*a*, 53*a*, 54*a*, 55*a*, 56*a*, and 58*a*, respectively; a porous material layer 60*a*, 62*a*, 63*a*, 64*a*, 65*a*, 66*a*, and 68*a*, respectively; and an abrasive particle layer 70*a*, 72*a*, 73*a*, 74*a*, 75*a*, 76*a*, and 78*a*, respectively. Each abrasive particle layer 72*a* through 76*a* is arranged in rows in the porous material as explained in more detail below. These layers are sintered together by top punch 84 and bottom punch 85 to form laminated sheet 80. As noted above, sintering processes suitable for the present invention are well known in the art and described in, for example, in U.S. Pat. No. 5,620,480, to Tselesin, which has been incorporated by reference in its entirety. Though FIG. 12 shows a single bond material layer for each thickness layer, it is also contemplated to include 2 or more bond layers for each thickness layer.

Figure 12B:
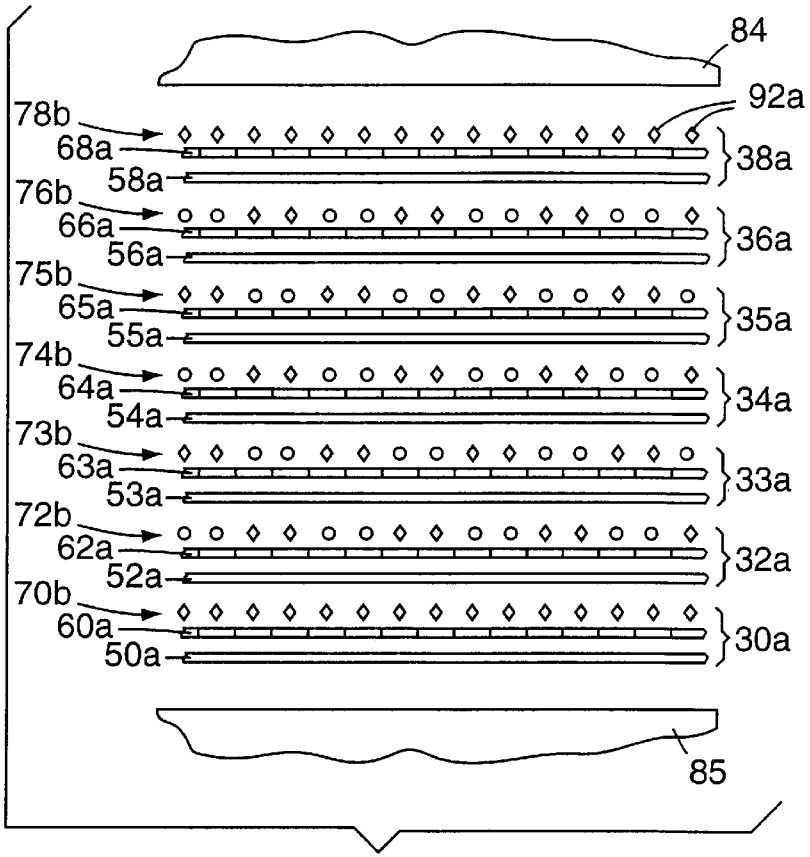
FIG. 12B is a front exploded view of a second embodiment of the laminated sheet of material shown in FIG. 11 including two different types of abrasive particles arranged in rows in abrasive particle layers.
Figure 12A:
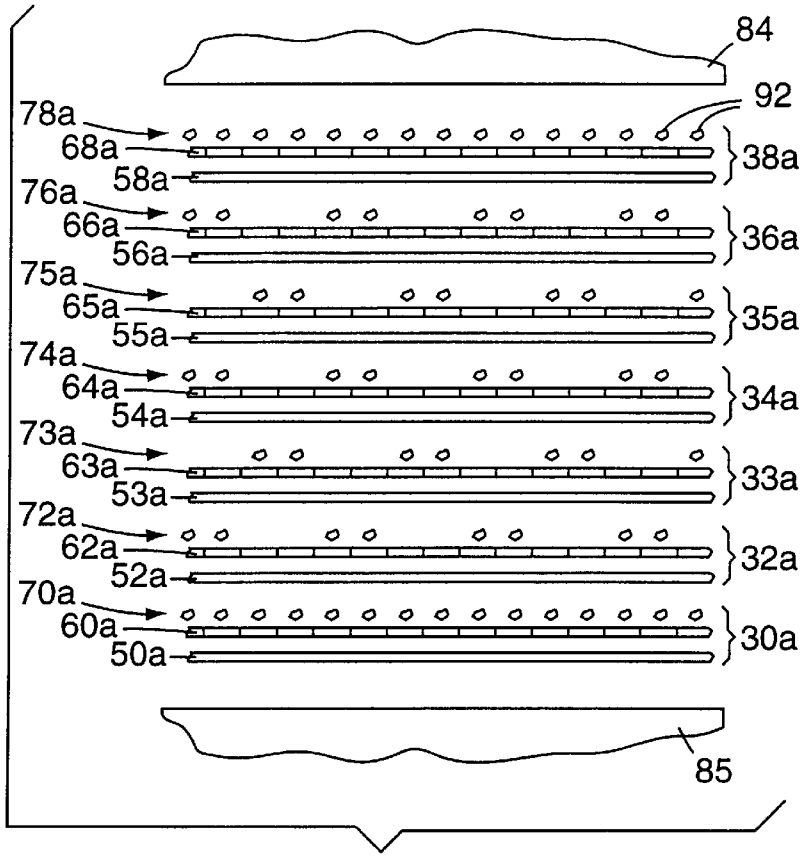
FIG. 12A is a front exploded view of a first embodiment of the laminated sheet of material shown in FIG. 11 including a plurality of layers bond material, a plurality of layers of porous material, and a plurality of layers of abrasive particles.

As shown in FIG. 12A, to form the alternating arrangement of hard regions and soft regions of segment 12*a*, the first abrasive particle layer 70*a* and the seventh abrasive particle layer 78*a* is each essentially continuous. That is, each opening 90 in porous layers 60*a* and 68*a* contains a superabrasive particle 92 of particle layers 70*a* and 78*a*, respectively. However, abrasive particle layers 72*a* through 76*a* are arranged in rows staggered with each other on alternating porous material layers. As such, abrasive particle layers 72*a* through 76*a* are discontinuous and, as shown in FIG. 11, consist of rows having widths corresponding to two rows of openings 90 in porous material layers 62*a* through 66*a*, respectively. The widths of the rows of abrasive particles 92 corresponds to the lengths in a circumferential direction of the hard regions 22*a* of segment 12*a*. It is also within the ambit of the present invention to form rows of abrasive particles of widths equal to one, three, four, or any number of adjacent rows of openings 90 in porous material layers 62*a* through 66*a*.

To form the checkerboard pattern of hard regions and soft regions of segment 12*a*, the rows of abrasive particle layers 72*a*, 74*a*, and 76*a* are shifted in a direction perpendicular to the rows a distance equal to the width of two adjacent rows of openings 90 in porous material layers 62*a*, 64*a*, and 66*a*, respectively, from the position of the rows of abrasive particle layers 73*a* and 75*a*.

It is further within the ambit of the present invention to place abrasive particles in the rows that in FIG. 12A have no abrasive particles, as shown in the embodiment of FIG. 12B, which is a front view of a front edge of a sheet such as sheet 80 shown in FIG. 11. Elements in FIG. 12B identical to those of FIG. 12A are labeled with the same alpha-numeric characters and elements in FIG. 12B functionally similar to those of FIG. 12A are labeled with the same numeral followed by a different letter. In FIG. 12B, layers of abrasive particles 72*b*, 73*b*, 74*b*, 75*b*, and 76*b* are arranged into two rows of two types of abrasive particles, 92*a* depicted in FIG. 12B as diamond shapes, and 92*b*, depicted in FIG. 12B as circles. Particles 92*a* are more abrasive than particles 92*b*. For example, particles 92*a* can be diamond and particles 92*b* can be silicon carbide. Accordingly, hard regions will contain diamond particles and soft regions will contain less hard silicon carbide particles.

The thickness layers 30*a*, 32*a*, 33*a*, 34*a*, 35*a*, 36*a*, and 38*a* are all sintered together by top punch 84 and bottom punch 85. Segments 12*a* are then cut by laser from resulting laminated sheet 80 of abrasive material substantially as shown in phantom in FIG. 11. The circumferential edge of segment 12*a* is cut substantially perpendicular to the rows of abrasive particles in abrasive particle layers 72*a*, 73*a*, 74*a*, 75*a*, and 76*a*.

The bond material can be any material sinterable with the abrasive particle layers and is preferably soft, easily deformable flexible material (SEDF) the making of which is well known in the art and is disclosed in U.S. Pat. No. 5,620,489 to Tselesin which has been incorporated by reference in its entirely. Such SEDF can be formed by forming a paste or slurry of bond material or powder such as tungsten carbide particles or cobalt particles, and a binder composition including a cement such as rubber cement and a thinner such as rubber cement thinner. Abrasive particles can also be included in the paste or slurry but need not be. A substrate is formed from the paste or slurry and is solidified and cured at room temperature or with heat to evaporate volatile components of the binder phase. The SEDF used in the embodiment shown if FIG. 12 to form bond material layers 50*a*, 52*a*, 53*a*, 54*a*, 55*a*, 56*a*, and 58*a* can include methylethylketone:toluene, polyvinyl butyral, polyethylene glycol, and dioctylphthalate as a binder and a mixture of copper, iron nickel, tin, chrome, boron, silicon, tungsten carbide, cobalt, and phosphorus as a bond material. Certian of the solvents will dry off after application while the remaining organics will burn off during sintering. Examples of exact compositions of SEDFs that may be used with the present invention are set out below and are available a number of suppliers including: All-Chemie, Ltd. of Mount Pleasant, S.C.; Transmet Corp. of Columbus, Ohio; Valimet, Inc., of Stockton, Calif.; CSM Industries of Cleveland, Ohio; Engelhard Corp. of Seneca, S.C.; Kulite Tungsten Corp. of East Rutherford, N.J.; Sinterloy, Inc. of Selon Mills, Ohio; Scientific Alloys Corp. of Clifton, N.J.; Chemalloy Company, Inc. of Bryn Mawr, Pa.; SCM Metal Products of Research Triangle Park N.C.; F.W. Wmter & Co. Inc. of Camden, N.J.; GFS Chemicals Inc. of Powell, Ohio; Aremco Products of Ossining, N.Y.; Eagle Alloys Corp. of Cape Coral, Fla.; Fusion, Inc. of Cleveland, Ohio; Goodfellow, Corp. of Berwyn, Pa.; Wall Colmonoy of Madison Hts, Mich.; and Alloy Metals, Inc. of Troy, Mich. It should also be noted that not every bond layer forming sheet 80 need be of the same composition, it is contemplated that one or more bond material layers could have different compositions.

The porous material can be virtually any material so long as the material is highly porous (about 30% to 99.5% porosity). Suitable materials are metallic non-woven materials, or wire woven mesh materials such a copper wire mesh. Particularly suitable for use with the present invention is a stainless steel wire mesh. In the embodiment shown in FIG. 12, a mesh is formed from a first set of parallel wires crossed perpendicularly with a second set of parallel wires to form porous layers 60*a*, 62*a*, 63*a*, 64*a*, 65*a*, 66*a*, and 68*a*. The exact dimensions of a stainless steel wire mesh which can be used with the present invention is disclosed below in the Examples section.

Figure 13A:
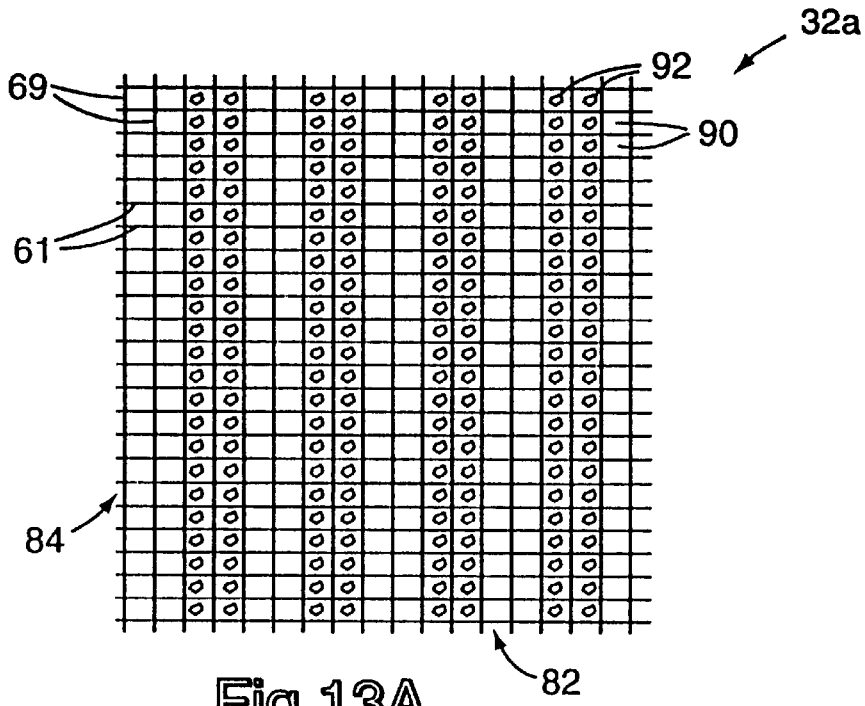
FIG. 13A is top view of a first embodiment of a layer of porous material for use with the present invention.
Figure 13B:
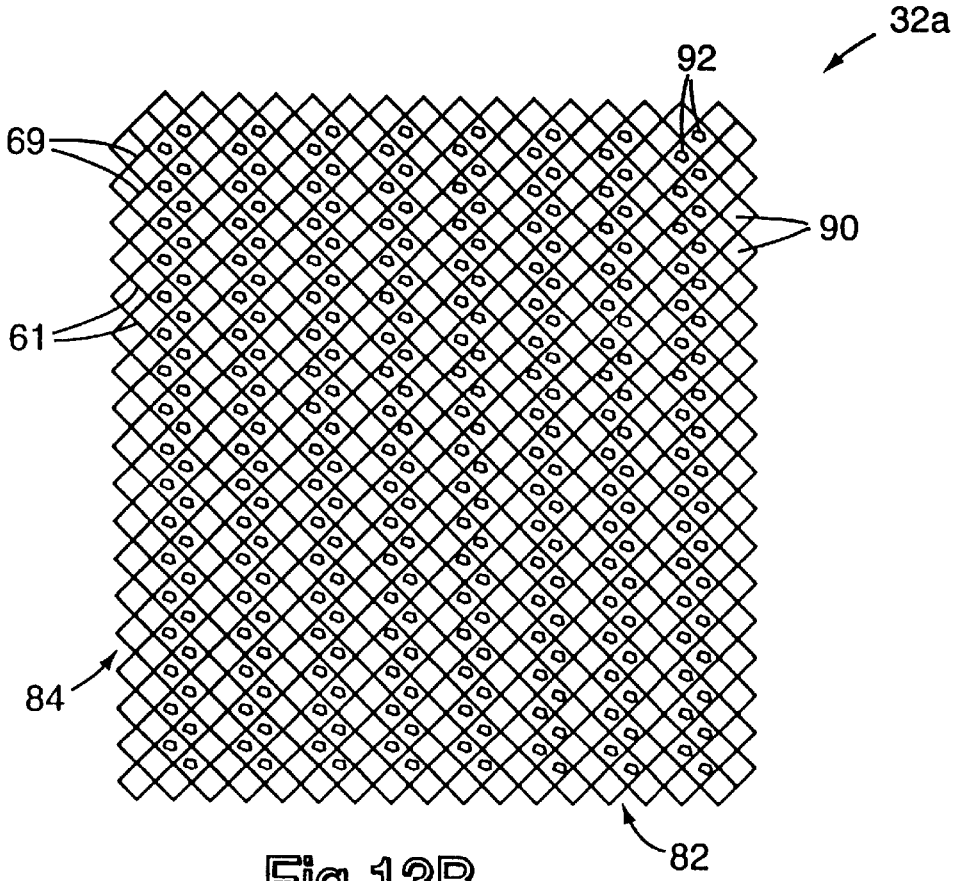
FIG. 13B is a top view of a second embodiment of a layer of porous material for use with the present invention.

As shown in FIG. 13A, which is atop view of a single thickness layer 32*a* of sheet 80, the first set of parallel wires 61 can be placed parallel with front edge 82 and the second set of parallel wires 69 can be placed parallel to side edge 84. However, as shown in FIG. 13B it is also possible to angle the porous layer such that the sets of parallel wires 61 and 69 are at a 45 degree angle with front edge 82 and side edges 84. The latter arrangement has the advantage of exposing more abrasive particles at the cutting edge of a work surface when a segment, for example, is cut from sheet 80.

Figure 14:
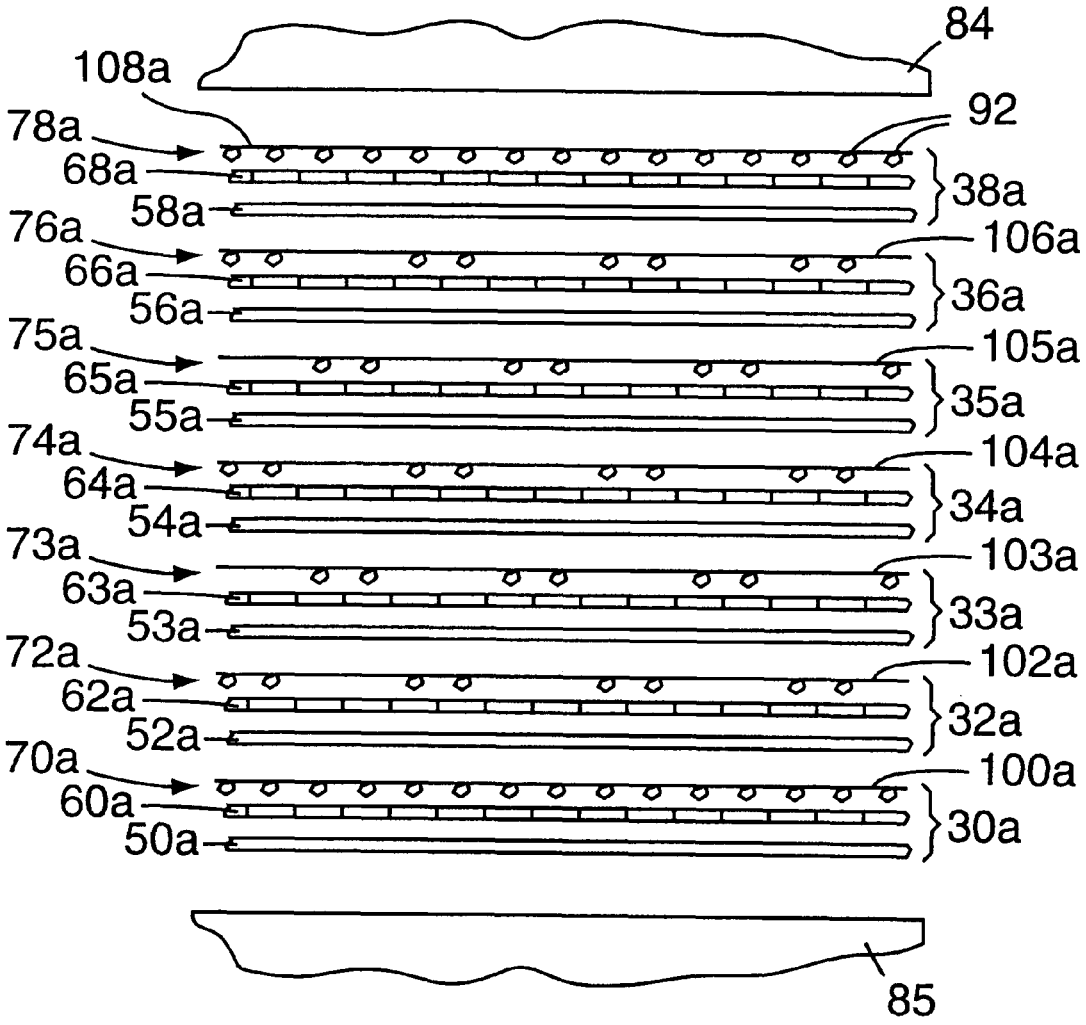
FIG. 14 is an exploded front view of a second embodiment of the laminated sheet of material shown in FIG. 11 including layer of adhesive substrate.

The abrasive particles 92 can be formed from any relatively hard substance such as diamond, cubic boron nitride, boron suboxide, boron carbide, and/or silicon carbide. Preferably diamonds of a diameter and shape such that they fit into the holes of the porous material are used as abrasive particles 92. The particles 92 can either be placed individually in openings 90 in the porous layers 60*a*, 62*a*, 63*a*, 64*a*, 65*a*, 66*a*, and 68*a*, or they can be pre-arranged on an adhesive substrates 100*a*, 102*a*, 103*a*, 104*a*, 105*a*, 106*a*, and 108*a*. FIG. 14 is a front exploded view of a sheet of the type shown in FIG. 11 including adhesive substrates 100*a*, 102*a*, 103*a*, 104*a*, 105*a*, 106*a*, and 108*a* to which the abrasive particles 92 have been attached. Elements in FIG. 14 identical to those of FIG. 12A are labeled with identical numerals. The adhesive substrates 100*a*, 102*a*, 103*a*, 104*a*, 105*a*, 106*a*, and 108*a* can then be sintered with the remainder of the layers that make up sheet 80. Also, the particles 92 can simply be arranged adjacent to the bond material layers 50*a*, 52*a*, 53*a*, 54*a*, 55*a*, 56*a*, and 58*a* without any porous material layers or adhesive substrate layers. Details of using adhesive substrates to retain abrasive particles to be used in a sintering process are disclosed in U.S. Pat. No. 5,380,390 to Tselesin which has been incorporated by reference in its entirety. If layers of porous material 60*a*, 62*a*, 63*a*, 64*a*, 65*a*, 66*a*, and 68*a* are used, they can be removed after placement of the abrasive particles 92 and before sintering but need not be.

As will be understood by one skilled in the art, the width of the rows of abrasive particles can be varied to produce varying lengths in a circumferential direction of hard regions and soft regions. Also, the staggering of the rows in the layers of abrasive particles between the different rows can be varied to produce a desired pattern of hard regions and soft regions. Moreover, the types of abrasive particles can be varied to produce desired patterns of regions having higher abrasiveness and regions having lower abrasiveness. In particular, the arrangements of hard regions and soft regions of segments 12*b* through 12*f* can be achieved by such varying of width of abrasive particle rows and position of rows in the layers of abrasive particles and/or types of abrasive particles in the rows.

Further, the layers of abrasive particles do not need to be arranged in rows. Rather, they can be arranged in groups of abrasive particles which can vary in concentration and type of abrasive particle along both a length and width of the layers of abrasive particles.

Bands of abrasive material such as wheel 40 can also be fabricated from the sheet of abrasive material 80. Wheel 40 can be cut by a laser from sheet 80 as shown in phantom in FIG. 11. The size of sheets of the type shown in FIG. 11 can be varied for fabricating different sizes of grinding wheels.

EXAMPLES

The following general procedure was used to prepare the saw segments of the present invention.

An open mesh screen having openings approximately 0.6 mm per side and 0.17 mm diameter stainless wire, was cut to 12.7 cm by 12.7 cm (5 inches by 5 inches). An abrasive particle, either diamond or silicon carbide, of approximately 0.42 mm diameter was dropped into each of the screen openings. Three patterns of abrasive particles were used: "full" - every screen opening had one diamond particle; "A" - alternating double rows of diamond and silicon carbide particles, where each opening of the first two rows had a silicon carbide particle; "B" - alternating double rows of diamond and silicon carbide particles, where each opening of the first two rows had a diamond particle.

Each of the powder mixtures of Bonds I, II, III and IV (in Table 1) were mixed with the following ingredients and knife coated onto a release liner to provide a flexible sheet of metal powder: 600 parts Bond, 67 parts 1.5:1 methylethylketone:toluene, 6 parts polyvinyl butyral, 2.26 parts polyethylene glycol having a molecular weight of about 200, and 3.74 parts dioctylphthalate. Each sheet was 161 $cm^2$ (25 $in^2$), approximately 5.6 mm (22 mils) thick and approximately 0.98 grams/$in^2$.

TABLE 1

| | BondI | BondII | BondIII | BondIV |
|---|---|---|---|---|
| copper | 35.9 | 22.9 | 10.8 | 24 |
| iron | 35.1 | 22.1 | 9.9 | 22 |
| nickel | 7.8 | 30.5 | 11 | 16 |
| tin | 4.1 | 2.4 | 1.4 | 3 |
| chrome | 5.6 | 7.9 | 3.4 | 6 |
| boron | 0.8 | 2 | 0.9 | 2 |
| silicon | 0.8 | 2 | 0.9 | 2 |
| tungsten carbide | 9 | 9.2 | 60.4 | 23 |
| cobalt | 0.8 | 0.8 | 0.9 | 2 |
| phosphorus | 0.2 | 0.2 | 0.5 | 0 |

The screens, filled with abrasive particles, and flexible sheets of metal powder were stacked upon each other to form a laminar composite. The specific layering sequence is detailed in each Example. The layered construction was sintered at approximately 1000° C. under a pressure of approximately 400 kg/$cm^2$ for about 4 minutes.

The composite was then cut into 33 arcuate segments 4 cm long with a laser, and then the segments were equally spaced on the periphery of a 35.5 cm (14 inch) diameter steel saw blade core.

Example 1 was prepared as described in the general procedure. The resulting layered construction was as follows:

Bond IV
"full"
Bond II
Bond II
"A"
Bond II
Bond II
"full"
Bond II
Bond II
"B"
Bond II
Bond II
"full"
Bond II
Bond II
"A"
Bond II
Bond II
"full"
Bond II
Bond II
"B"
Bond II
Bond II
"full"
Bond IV Example 2 was prepared as described in the general procedure. The resulting layered construction was as follows:

Bond IV
"full"
Bond IV
10 Layers Bond II with 6.25 volume percent diamond to the metal powder
Bond IV
"full"
Bond IV Comparative Example A was a concrete saw commercially available from Diamont Boart Felker (Kansas City, Mont.) under the trade designation "Gold Star Supreme".

Examples 1 and 2 and Comparative Example A were tested on cured "Houston Hard" aggregate concrete using a gas powered walk-behind saw operating at approximately 2700 rpm with water supplied to each side of the blade. Cut rate and projected saw life are reported in Table 2.

TABLE 2

| Example | Cut Rate cm-meters/min (inch-ft/min) | Projected Life cm-meters (inch-ft) |
|---|---|---|
| 1 | 10.1(13) | 2322(3000) |
| 2 | 11.6(15) | 1355(1750) |
| Comp. A | 7.7 (10) | 1935 (2500) |

Example 3 was prepared as described in the general procedure. The resulting layered construction was as follows:

Bond IV
"full"
Bond I
Bond I
"A"
Bond I
Bond I
"full"
Bond I
Bond I
"B"
Bond I
Bond I
"full"
Bond I
Bond I
"A"
Bond I
Bond I
"full"
Bond IV Comparative Example B was a concrete saw commercially available from Cushion Cut Company of Torrance, Calif. under the trade designation "CC-24 Supreme 6.0".

Example 3 and Comparative Example B were tested on cured "Denver Medium Hard" aggregate concrete using a gas powered walk-behind saw operating at approximately 2700 rpm with water supplied to each side of the blade. Cut rate and projected saw life are reported in Table 3.

TABLE 3

| Example | Cut Rate cm-meters/min (inch-ft/min) | Projected Life cm-meters (inch-ft) |
|---|---|---|
| 3 | 27.9(36) | 9290(12000) |
| Comp. B | 18.6(24) | 7742(10000) |

Comparative Example C was a concrete saw commercially available from Terra Diamond Industrial (Salt Lake City, Utah).

Example 4 was prepared as described in the general procedure. The resulting layered construction was as follows:

Bond III
"full"
Bond III
Bond III
"A"
Bond III
Bond III
"full"
Bond III
Bond III
"B "
Bond III
Bond III
"full"
Bond III
Bond III
"A"
Bond III
Bond III
"full"
Bond III Example 4 and Comparative Example C were tested on green "Denver Medium Hard" aggregate concrete using a gas powered walk-behind saw operating at approximately 2700 rpm with water supplied to each side of the blade. Cut rate and projected saw life are reported in Table 4.

TABLE 4

| Example | Cut Rate cm-meters/min (inch-ft/min) | Projected Life cm-meters (inch-ft) |
|---|---|---|
| 4 | 34.8(45) | 14518(18752) |
| Comp. C | 23.2(30) | 12387(16000) |

Though the present invention has been described with reference to preferred embodiments, those skilled in the are will recognize that changes can be made in form and detail without departing from the spirit and scope of the invention.

What is claimed is:

1. A tool for cutting and grinding comprising:

an abrasive work surface having a cirumferential dimension orthogonal to an axial dimension;

a plurality of first regions spaced in the circumferential dimension and the axial dimension on the abrasive work surface; and a plurality of second regions spaced in the circumferential dimension and the axial dimension on the abrasive work surface, wherein each first region is more wear resistant than each second region such that each second region will wear faster than each first region;

wherein the work surface is divided in the axial dimension into a plurality of layers extending in the circumferential dimension and orthogonal to the axial dimension; wherein the plurality of layers include a first exterior layer and a second exterior layer and at least one inner layer located between the first exterior layer and the second exterior layer; wherein the at least one inner layer is divided along the circumferential direction into at least one inner layer is divided along the circumferential direction into at least one first region and at least one second region.

2. The tool of claim 1 wherein a first exterior layer forms a first external edge of the work surface, a second external layer forms a second external edge of the work surface, and a plurality of interior layers are located between the first exterior layer and the second exterior layer.

3. The tool of claim 2 wherein each of the plurality of interior layers is divided along the circumferential direction into first regions and second regions and the first exterior layer includes only a first region and the second exterior layer includes only a first region.

4. The tool of claim 3 wherein each layer has substantially the same width.

5. The tool of claim 4 wherein the first regions and the second regions of the interior layers are all of approximately equal circumferential length and the first regions and the second regions of adjacent interior layers are offset from each other along the circumferential dimension by a distance equal to the circumferential length of each first region.

6. The tool of claim 4 including:

a first interior layer adjacent to the first exterior layer, a second interior layer adjacent to the second exterior layer, the first interior layer and the second interior layer each having first regions of approximately one third the circumferential length of second regions thereof, and a third interior layer located between the first and second interior layers and having first regions of approximately the same circumferential length as second regions thereof.

7. The tool of claim 6 wherein the first regions of the interior layers are all of approximately equal length and the first regions of adjacent interior layers are all offset from each other along the circumferential dimension by a distance equal to the circumferential length of each first region.

8. The tool of claim 4 wherein the first regions of each interior layer are all approximately four times the circumferential length of the second regions of each interior layer and centers along the circumferential dimension of the first regions of adjacent interior layers are aligned with centers along the circumferential dimension of the second regions thereof.

9. The tool of claim 8 including three interior layers.

10. The tool of claim 4 including:

a first interior layer adjacent to the first exterior layer;

a second interior layer adjacent to the second exterior layer, the first interior layer and the second interior layer each having first regions of approximately equal circumferential length as second regions thereof; and a third interior layer located between the first interior layer and the second interior layer and including only a first region.

11. The tool of claim 5 including anywhere from one to seven interior layers.

12. The tool of claim 1 including:

a first layer divided in the circumferential dimension into first regions and second regions, each second region having approximately three times a circumferential length of each first region;

a second layer divided in the circumferential dimension into first regions and second regions, each second region having approximately three times a circumferential length of each first region; and a third layer divided along the circumferential dimension into first regions and second regions, each first region having a circumferential length approximately equal to that of each second region thereof wherein the first regions of adjacent interior layers are all offset from each other along the circumferential dimension by a distance equal to the circumferential length of the first regions.

13. The tool of claim 1 including three layers wherein a each layer is divided in the circumferential dimension into first regions and second regions, the first regions having approximately equal circumferential length as the second regions, wherein the first regions of adjacent layers are offset in the circumferential dimension by a distance equal to the circumferential length of the first and second regions.

14. The tool of claim 14 including a rigid circular hub having a perimeter surface to which the plurality of arcuate segments are attached.

15. The tool of claim 14 including a ridge circular hub having a perimeter surface to which the plurality of arcuate segments are attached.

16. The tool of claim 1 wherein the work surface is a continuous circular band having a curvature approximately equal to that of the circular hub.

17. The tool of claim 1 wherein the first regions and the second regions include abrasive particles.

18. The tool of claim 1 wherein the abrasive particles included in each first region are harder than the abrasive particles included in each second region.

19. The tool of claim 18 wherein the abrasive particles included in each first region include diamonds and the abrasive particles included in each second region include silicon carbide particles.

20. The tool of claim 1 wherein the concentration of abrasive particles included in each first region is higher than the concentration of abrasive particles included each second region.

21. The tool of claim 1 wherein the first regions and the second regions include bond material.

* * * * *

UNITED STATES PATENT AND TRADEMARK OFFICE

CERTIFICATE OF CORRECTION

PATENT NO. : 6,110,031
DATED : August 29, 2000
INVENTOR(S) : Preston, Jay B.

It is certified that error appears in the above-identified patent and that said Letters Patent is hereby corrected as shown below:

Column 1,
Line 4, delete "1." preceding "Field".
Line 9, delete "2." preceding "Description".

Column 6,
Line 6, insert -- . -- following "thereof".

Signed and Sealed this

Eleventh Day of November, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,110,031
APPLICATION NO. : 08/882434
DATED : August 29, 2000
INVENTOR(S) : Jay B. Preston It is certified that error appears in the above-identified patent and that said Letters Patent is hereby corrected as shown below:

Column 1,
Line 4, delete "1." preceding "Field".
Line 9, delete "2." preceding "Description".

Column 6,
Line 6, insert --.-- following "thereof".

Column 15
Lines 33-34, delete "at least one inner layer is divided along the circumferential direction into"

Column 16
Line 43, delete "14. The tool of claim 14 including a rigid circular hub having a perimeter surface to which the plurality of arcuate segments are attached.", and insert --14. The tool of claim 1 wherein the work surface is formed from a plurality of arcuate segments of approximately equal length.--

Line 46, claim 15 delete "ridge" and insert --rigid--

Line 62, claim 20 after "included" insert --in--

Signed and Sealed this

Twenty-ninth Day of January, 2008

JON W. DUDAS
*Director of the United States Patent and Trademark Office*